United States Patent [19]

Hayashi et al.

[11] Patent Number: 5,075,729

[45] Date of Patent: Dec. 24, 1991

[54] IMAGE FORMING APPARATUS HAVING A DEVELOPING AND CLEANING FUNCTION USING A CONTROLLED POTENTIAL DIFFERENCE BETWEEN SURFACE AND DEVELOPING BIAS

[75] Inventors: Masao Hayashi; Kenichi Tsuneeda; Katsuhide Sano, all of Yokohama, Japan

[73] Assignee: Kabushiki Kaisha Toshiba, Kawasaki, Japan

[21] Appl. No.: 257,005

[22] Filed: Oct. 13, 1988

[30] Foreign Application Priority Data

Oct. 14, 1987 [JP] Japan ..... 62-258674

[51] Int. Cl.[5] ..... G03G 15/06; G03G 15/24; G03G 21/00

[52] U.S. Cl. ..... 355/269; 355/296; 355/301

[58] Field of Search ..... 355/245, 246, 251, 269, 355/270, 296, 297, 301

[56] References Cited

U.S. PATENT DOCUMENTS

| | | | |
|---|---|---|---|
| 4,053,218 | 10/1977 | Mikolas | 355/269 |
| 4,372,669 | 2/1983 | Fantuzzo et al. | 355/269 X |
| 4,432,631 | 2/1984 | Bacon et al. | 355/269 X |
| 4,500,198 | 2/1985 | Daniels | 355/270 |
| 4,754,304 | 6/1988 | Ohashi et al. | 355/270 |

FOREIGN PATENT DOCUMENTS

| | | | |
|---|---|---|---|
| 59-33470 | 2/1984 | Japan | 355/269 |

*Primary Examiner*—Fred L. Braun
*Attorney, Agent, or Firm*—Cushman, Darby & Cushman

[57] ABSTRACT

An image-forming apparatus that has a photosensitive drum. The drum is charged by a main charger to a surface potential Vo. A light beam bearing image information is applied after the transfer of the developed image and before the next image forming operation to facilitate cleaning thereof.

6 Claims, 5 Drawing Sheets

IMAGE FORMING APPARATUS HAVING A DEVELOPING AND CLEANING FUNCTION USING A CONTROLLED POTENTIAL DIFFERENCE BETWEEN SURFACE AND DEVELOPING BIAS

BACKGROUND OF THE INVENTION

1. Field of the Invention

The present invention relates to an image-forming apparatus which may be used in various devices such as, for example, laser printers, copy machines, fax machines, etc. which form an image on a reusable image carrier.

2. Description of the Prior Art

An image-forming apparatus comprises a photosensitive drum which is rotated in a predetermined direction. The drum is surrounded by a main charger, an exposure section of an exposure system, a developing unit, a transfer charger, a separation charger, a cleaner, and a de-electrifier, which are arranged successively in the rotating direction of the drum.

To form an image on a sheet of paper, first, the surface of the photosensitive drum is charged uniformly by the main charger. The charged surface is exposed by an exposure system (the exposure system may include an optical system such as in a copier, a laser-optical system such as in a laser printer, etc.) to form an electrostatic latent image on the surface of the photosensitive drum. After the latent image is formed on the drum, toner is then applied to the surface of the drum by the developing unit. As a result, the latent image becomes visible. In other words, it is developed into a toner image. Then, the toner image is transferred, by the transfer charger, to the surface of a paper sheet which is brought into contact with the surface of the drum. After the toner image is transferred to the paper, the paper sheet is separated from the drum by the separation charger.

Those toner particles remaining on the surface of the photosensitive drum, without having been transferred to the sheet surface, are removed by the cleaner. Thereafter, the electrostatic latent image on the surface of the drum is erased to complete one cycle of image formation.

Conventionally, residual toner particles on the surface of the photosensitive drum are scraped from the drum surface by a blade attached to the cleaner. The scraped toner is collected in the cleaner. Usually, the internal space of the cleaner is filled up with the toner after 2,000 to 3,000 sheets of paper are printed. As a result, the cleaner becomes unusable.

Image-forming apparatuses with the above described construction include ones which are designed so that the cleaner which is full of scraped toner particles can be discarded together along with the photosensitive drum when the drum is replaced. In these apparatuses, however, the "expendables" are expensive. In the case of frequently used apparatuses, such as printers, there is a significant "down time" during replacement of the cleaner and the drum. Therefore, such apparatuses are not preferred.

In some prior art image-forming apparatuses, a toner conveyor screw for toner recovery is provided within the cleaner. The screw conveys toner from the cleaner to a toner recovery box outside the cleaner, thereby recovering it. Because the recovery box is located inside the apparatus, it must be fairly small. After the image is formed on several thousands of sheets of paper, the box must be replaced with a new one. At the time of removal of the box, some of the toner may spill, thereby soiling the operator's hands or clothes or the floor.

Another problem with this conventional arrangement is that the blade of the cleaner is brought into contact with the surface of the photosensitive drum. Sometimes the surface of the drum is scratched by the blade.

An OPC (organic photoconductor) photosensitive drum is generally safe and harmless to use. However, due to its softness, the drum has only a very short life. If the photosensitive drum has a short diameter, in particular, it must rotate many times to accomplish recording on each paper sheet. Accordingly, one and the same portion of the drum must be used so frequently for printing each sheet that the life and the replacement cycle of the drum are inevitably short. It is not advisable, therefore, to use a slender photosensitive drum. Thus, the apparatus cannot be easily reduced in size.

In an effort to overcome these operational problems, image-forming apparatuses without cleaners have been developed. Such a device is described in U.S. Pat. No. 4,664,504, issued May 12, 1987, the teachings of which are incorporated herein by reference. In the device described in U.S. Pat. No. 4,664,504, the developing unit also has a cleaning function; that is, development and cleaning are effected simultaneously by means of the developing unit.

In the image-forming apparatuses of this type, however, defective cleaning is subject to occur; therefore, an image formed by the process corresponding to the preceding revolution of the photosensitive drum appears in a present image on a paper sheet.

SUMMARY OF THE INVENTION

The object of the present invention is to provide an image forming apparatus that can be made smaller and lighter than conventional arrangements without requiring use of a toner recovery box, obviating the possibility of soiling and allowing an image carrier to have a longer useful life.

The present invention provides an image-forming apparatus which comprises charging means for charging an image carrier to a surface potential Vo; exposure means for applying a light beam defining an image to be printed to the image carrier which has been charged by the charging means, thereby forming an electrostatic latent image corresponding to the image to be printed; developing means, biased to a potential Vb so that a difference potential $|Vo-Vb|$ between the surface potential Vo and the developing bias potential Vb is more than 50 V and less than 300 V for developing the electrostatic latent image means of a developing agent, thereby forming a developer image on the surface of the image carrier; and transfer means for transferring the developed image from the image carrier to a recording medium, the developing means including means for, simultaneously with the development of the electrostatic latent image, removing the developing agent remaining on the surface of the image carrier after the transfer by the transferring means.

According to this arrangement, the developing agent remaining on the surface of the image carrier is removed simultaneously with the development by electrical attraction using the developing means. Therefore, the apparatus can be reduced in size and weight without requiring use of a toner recovery box, cannot soil anything, and allows the image carrier to have a longer useful life. The difference potential |Vo−Vb| between the surface potential Vo and the developing bias potential Vb is more than 50 V and less than 300 V; thereby, the residual toner particles are perfectly removed.

DETAILED DESCRIPTION OF THE PREFERRED EMBODIMENTS

Figure 1:
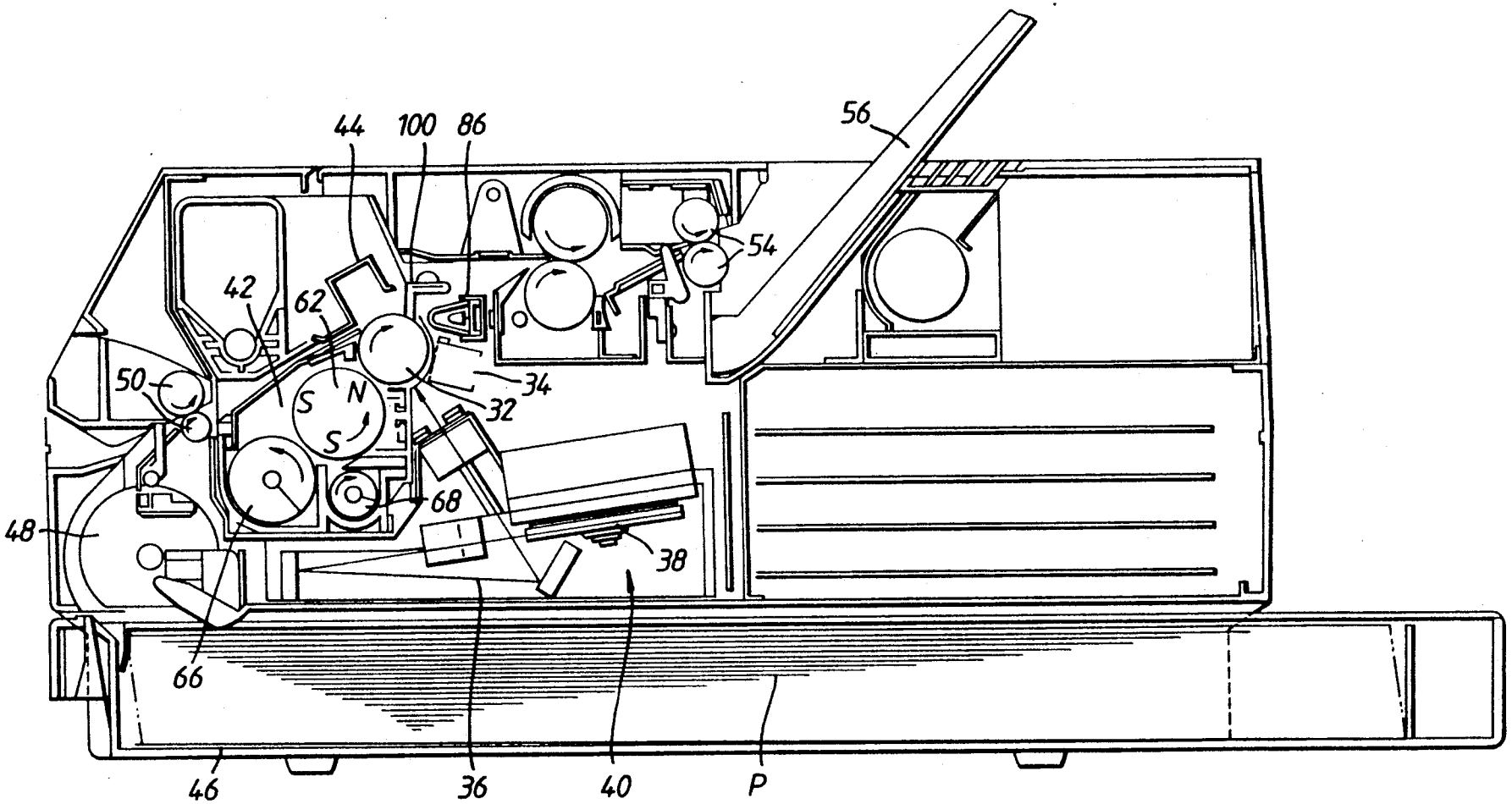
FIG. 1 is a sectional view schematically showing an image-forming apparatus according to the present invention incorporated into a laser printer.

FIG. 1 shows a laser-beam printer incorporating an image-forming apparatus according to the present invention. The laser printer utilizes a semiconductor laser. Even though the invention is described in the context of a laser-beam printer, as a matter of convenience, the invention is not limited to laser printers. It is applicable to copy machines, fax machines, etc.

The laser printer, when being used, is connected to a host system (not shown), e.g., a word processor via a cable and interface (not shown). Print signals are provided by the host system. In response to these print signals, the printer forms an image.

When a print start signal is provided by the host system to the printer, photosensitive drum 32 is rotated. First, the surface of drum 32 is charged electrically by main charger 34. When dot image data is then supplied from the host system to the printer, laser beam 36, modulated in accordance with the data, is emitted from optical system 40, including polygon scanner 38, and is guided to the drum surface. The charged drum is exposed to, and scanned with, laser beam 36. Thereupon, an electrostatic latent image is formed on the surface of drum 32. Then, a toner is applied to the latent image by means of developing device 42. As a result, the latent image becomes visible, i.e. is developed into a toner image. The toner image is transferred to the surface of paper sheet P by transfer charger 44 at a transfer section. Sheet p is fed from sheet cassette 46 to the transfer section by means of paper-supply roller 48 and a pair of aligning rollers 50. After the transfer, sheet p, with the toner image thereon, is delivered to a pair of fixing rollers 52. The toner image is fixed on the surface of sheet P by means of rollers 52. Then, sheet P is discharged onto tray 56 by a pair of exit rollers 54.

After the transfer of the toner image, in order to easily remove residual toner t (not shown), the surface of drum 32 is in sliding contact with brush member 100. Residual toner t on drum 32 is disturbed and the adherent position of residual toner t on drum 32 is changed thereby. Next, the surface of drum 32 is discharged by de-electrifier 86 to erase the electrostatic latent image thereon. Thus, one cycle of image formation is finished.

Figure 2:
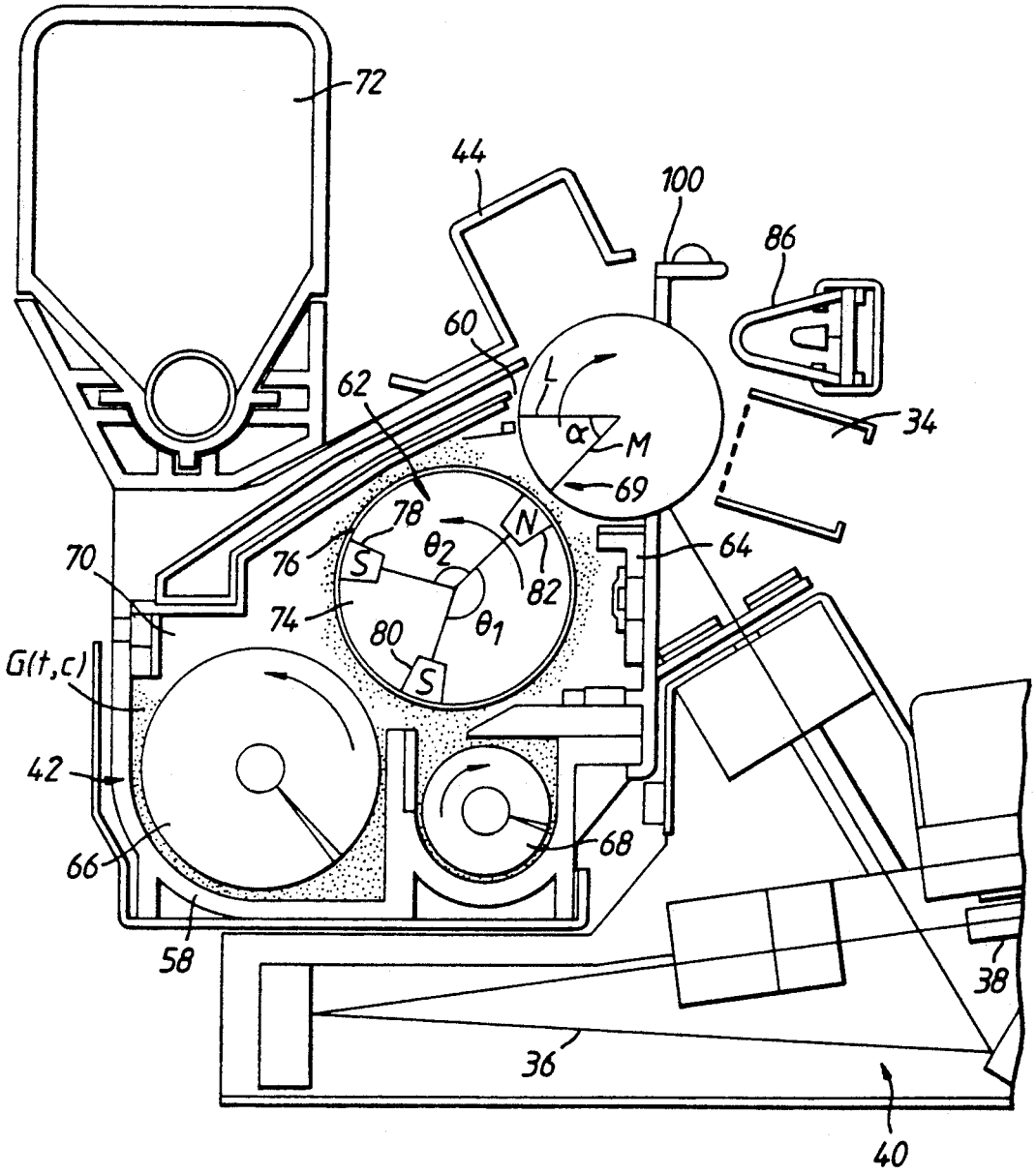
FIG. 2 is a sectional view schematically showing the image forming device according to the present invention and peripheral equipment associated therewith.

FIG. 2 is a sectional view schematically showing the image forming device according to the present invention and peripheral equipment associated therewith. Developing device 42 includes casing 58 which has opening 60. Photosensitive drum 32 is located within casing 58.

Casing 58 also contains developing roller 62, doctor 64, stirring conveyor 66 and stirring supplier 68. Doctor 64 is located in the region where photosensitive drum 32 is in sliding contact with a magnetic brush of a developing agent on developing roller 62, that is, on the upper-course side of developing position 69 with respect to the rotating direction of developing roller 62. Doctor 64 serves to restrict the thickness of the magnetic brush. Stirring conveyor 66 and stirring supplier 68 are contained in developer storage portion 70 inside casing 58. Stirring conveyor 66 stirs and conveys replenishing toner t from toner hopper 72 to stirring supplier 68. Stirring supplier 68 stirs and supplies developing roller 62 with toner t. In developer storage portion 70 there is stored developing agent G which is composed of toner (color powder) t and carrier (magnetic powder) c. Toner hopper 72 stocks new toner t and replenishes toner t to storage portion 70. Toner t and carrier c are triboelectrically charged by friction with each other or by the action of peripheral equipment, such as developing roller 62, stirring conveyor 66, stirring supplier 68, etc.

Developing roller 62 includes magnetic roller 74 and sleeve 76. The center of rotation of roller 74 is situated on line M passing through the center of rotation of photosensitive drum 32 and inclining at angle $\alpha$ (about 50°) to horizontal line L. Sleeve 76, which is fitted on roller 74, is rotated in the counterclockwise direction of FIG. 2.

Magnetic roller 74 includes three pole blocks 78, 80 and 82. Blocks 78 and 80 are south poles and block 82 is a north pole. Angle $\Theta_1$ between blocks 80 and 82, around the center of developing roller 62, is set to 150°, and angle $\Theta_2$ between blocks 82 and 78, around the center of roller 62, is set to 120°.

A reverse development process is carried out in developing device 42 described above. After the transfer of the toner image, residual toner t on photosensitive drum 32 is removed simultaneously with the development of the electrostatic latent image. Thus, drum 32 can enjoy a longer life and the electrophotographic process is simplified. FIGS. 3A to 3D and 4A to 4D show the state of toner particles t o drum 32 and changes of the surface potential of drum 32 during the process.

Figure 4A:
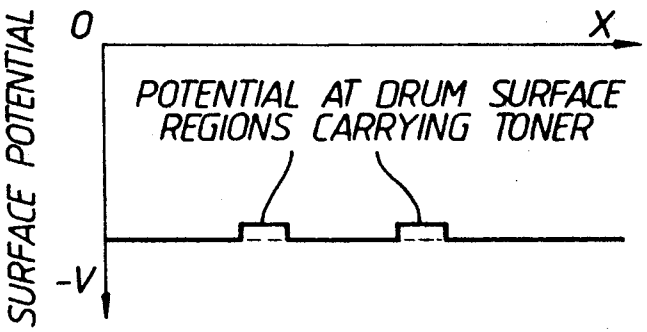
FIGS. 4A to 4D show transitions of the surface potential of a photosensitive drum during the processes of image formation by the apparatus of FIG. 1.
Figure 3A:
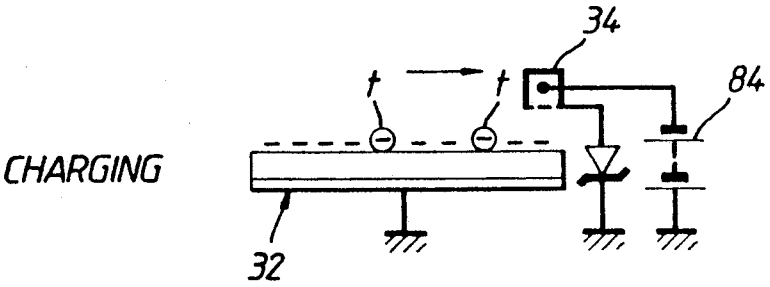
FIGS. 3A to 3D are diagrams illustrating processes of image formation by the apparatus shown in FIG. 1.

As shown in FIGS. 3A and 4A, photosensitive drum 32 is charged to a level of e.g. −600 V (hereinafter referred to as surface potential of drum 32) as main charger 34 is supplied with voltage from power source 84. At the same time, toner particles t remaining on drum 32, without having been transferred from drum 32 to sheet P by the previous copying operation, are charged. At the same time, those portions of drum 32 having residual toner particles t thereon are also charged. The reason for this situation has been made clear by an experiment. In this experiment, when toner t was removed by means of a blade, such as a polyurethane blade, the surface potential of the portions of drum 32 having had the residual toner particles thereon was kept at 80 to 90% of that of those drum portions without any residual toner particles.

In the apparatus according to this embodiment, the surface potential of photosensitive drum 32 is made uniform by using a scorotron charger as main charger 34. As mentioned before, therefore, the surface potential of the portions of drum 32 having had the residual toner particles thereon is only little lower than that of the portions without the residual toner particles. Practically, such a potential difference is negligible.

Figure 4B:
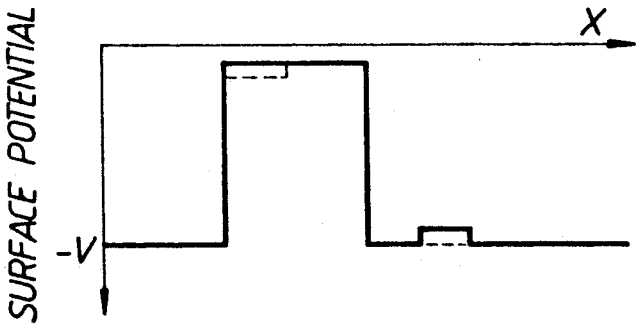
Figure 3B:
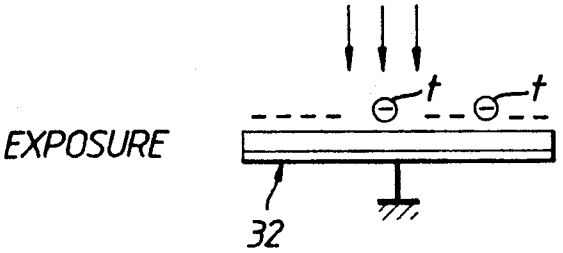

As described above, the surface of photosensitive drum 32 is exposed to laser beam 36 which is modulated on the basis of the dot image data from the host system. By doing this, the surface potential of drum 32 is attenuated. Consequently, the electrostatic latent image is formed on the drum, as shown in FIGS. 3B and 4B.

Figure 4C:
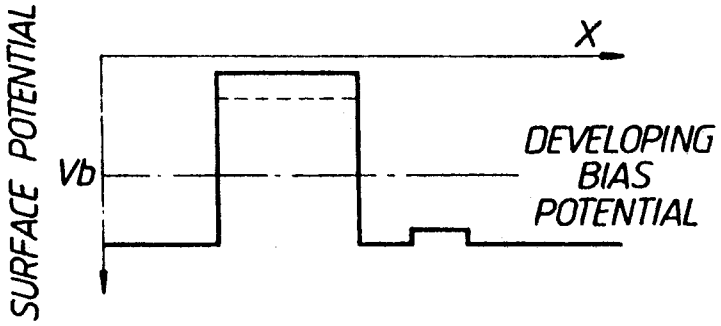
Figure 3C:
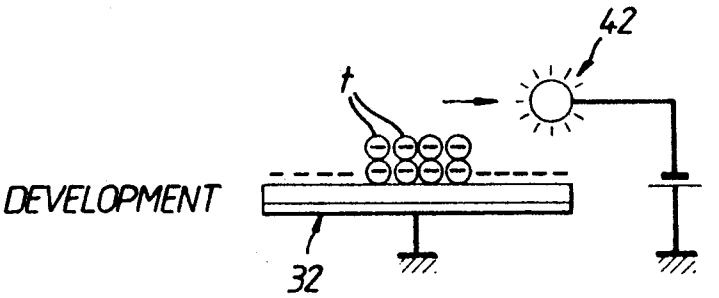

The electrostatic latent image is developed by developing device 42. More specifically, device 42 supplies toner (color powder) t to the latent image, thereby developing it into a toner image. At the same time, residual toner particles t, which are not necessary for the formation of the toner image, are removed by means of the developing device, as shown in FIGS. 3C and 4C.

Figure 4D:
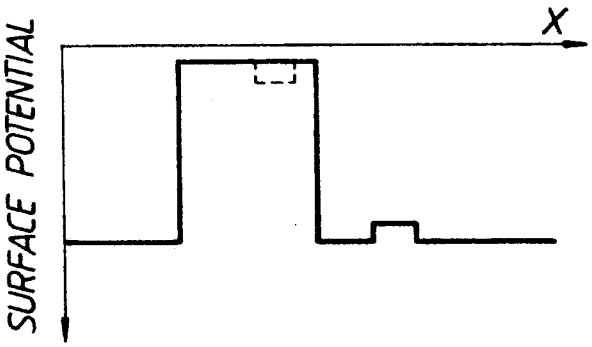
Figure 3D:
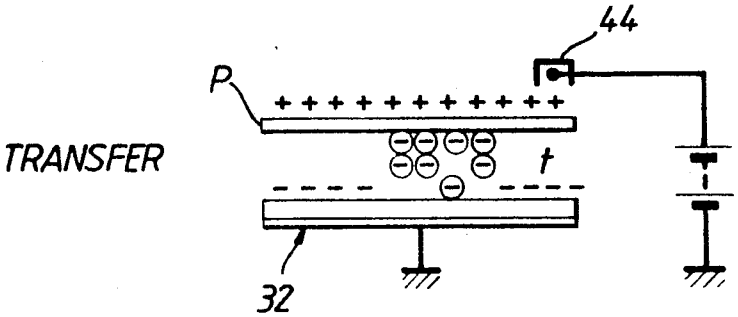

The toner image is transferred to the surface of sheet P by means of transfer charger 44. Namely, a high-voltage opposite in polarity to the negatively charged toner is applied by charger 44. As a result, the reverse side of sheet P is subjected to positive corona discharge, so that the sheet is charged positively. Thereupon, the negative toner image on photosensitive drum 32 is attracted to sheet P, as shown in FIGS. 3D and 4D.

The principles, conditions, experimental data, etc. of the present invention will now be described.

It is essential to execute the aforementioned process for simultaneous development and cleaning (hereinafter referred to as cleaning-synchronized development process) by the so-called reverse development method. The reason is that toner t and photosensitive drum 32 are charged for the same polarity, so that the polarity of residual toner t can never be inverted by the charging operation of main charger 34.

Moreover, it is important to use a magnetic brush in the reverse development method. Residual toner t is removed by a mechanical force for removal using the magnetic brush of developing agent and an electrical attraction produced by a difference potential between drum 32 and developing roller 62.

It is difficult make a developing agent that also performs as a cleaner. Materials that operate well as developers do not clean well and those materials that clean well are generally not good developers.

In the case of reverse development, toner t is transferred from developing roller 62 to the surface regions of drum 32, which is exposed after the charging process by main charger 34, basically by developing bias potential Vb applied to developing roller 62. While, in the case of cleaning, residual toner t is attracted from the surface regions of drum 32, which is unexposed, to developing roller 62 basically by the difference potential $|Vo-Vb|$ between surface potential Vo of the drum which is charged by main charger 34 and developing bias potential Vb.

Accordingly, in order to obtain satisfactory image quality, this difference potential $|Vo-Vb|$ must be taken into consideration as an important element of a cleaning-synchronized development process.

In this embodiment, drum 32 is an OPC (organic photoconductor) photosensitive drum which is suitable for negative charging. In consideration of use of a photosensitive drum suitable for positive charging, however, Vo, Vb, and $Vo-Vb$ are given as absolute values.

Figure 5:
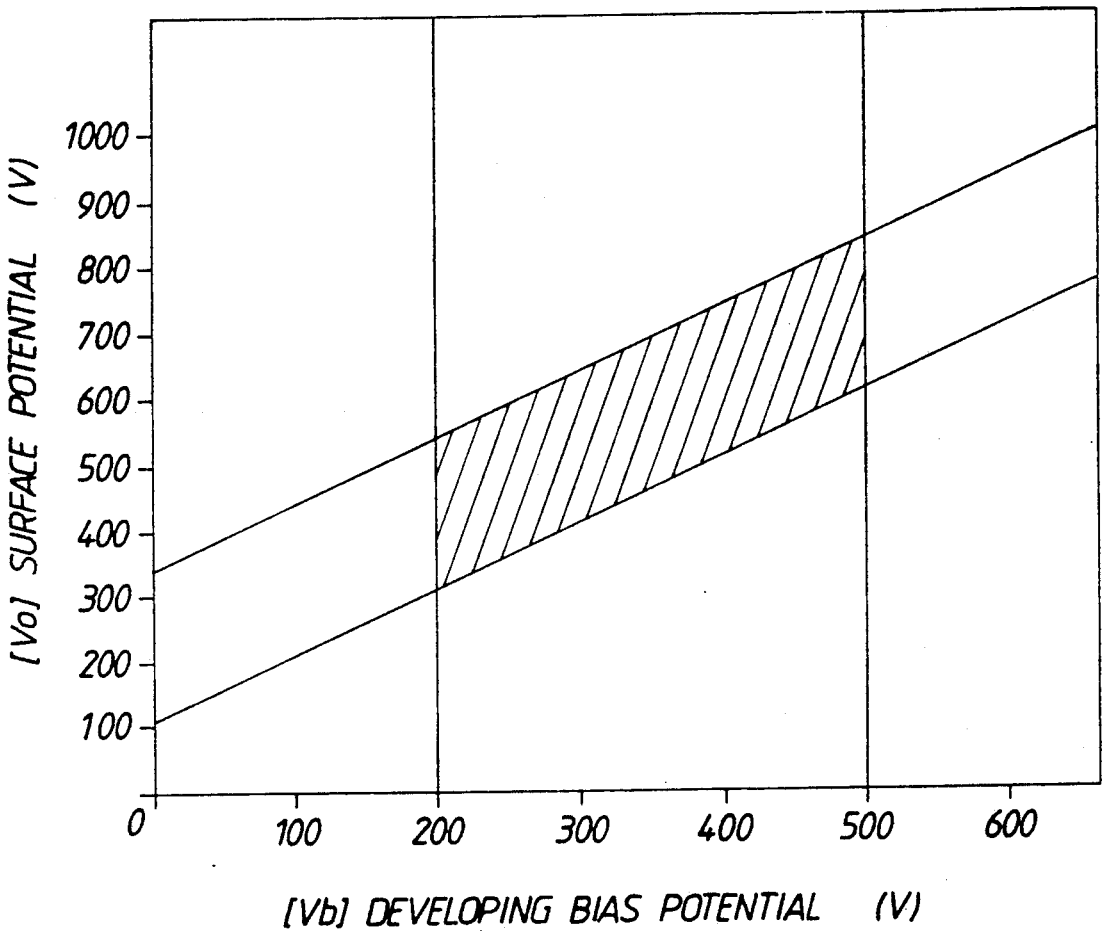
FIG. 5 is a diagram showing the relationships between the surface potential of the photosensitive drum and developing bias potential of the developing roller of the apparatus of FIG. 1.

Measurement data indicative of the relationships between developing bias potential $|Vb|$ and surface potential $|Vo|$ are shown in FIG. 5. If developing bias potential $|Vb|$ is lower than 200 V, image density becomes poor while, if developing bias potential $|Vb|$ is higher than 500 V, narrow lines of the image are not properly formed.

In experiments with various surface potentials, satisfactory image quality is obtained when developing bias potential $|Vb|$ and surface potential $|Vo|$ are shown a potential within the shaded region shown in FIG. 5. That is, difference potential $|Vo-Vb|$ should be more than 50 V and less than 300 V.

Non-shaded regions shown in FIG. 5 indicate occurrence of a phenomenon (hereinafter referred to as memory) such that the image formed by the process corresponding to the preceding revolution of drum 32 appears in the present image on paper sheet p, due to defective cleaning. If difference potential $|Vo-Vb|$ is lower than 50 V, it is impossible to perfectly remove residual toner t, due to the weakness of the electrical attraction by difference potential $|Vo-Vb|$; thus, the memory attributable to defective cleaning is produced.

If difference potential $|Vo-Vb|$ becomes too high, however, a charge is transferred inversely from developing roller 62 to toner t. As a result, toner t never fails to be charged for the opposite polarity. Thus, if difference potential $|Vo-Vb|$ becomes higher than 300 V, the image will suffer fogging.

A carrier with the maximum magnetic force of 50 to 150 emu/g was used as carrier c in developing agent G, and development was performed with pole 80 of developing roller 62 adjusted to a magnetic flux density of 1,000 gauss. Thereupon, carrier c adhered to photosensitive drum 32 when difference potential $|Vo-Vb|$ was greater than 300 V. Thus, it may be understood that potential $|Vo-Vb|$ should preferably be more than 50 V and less than 300 V.

The present invention is not limited to the above embodiment, and various other changes and modifications may be made within the spirit and scope of the invention.

What is claimed is:

1. An image-forming apparatus, using a reusable image carrier, for forming an image on a recording medium comprising:

charging means for charging said image carrier to a predetermined surface potential Vo, said surface potential Vo being more that 250 V and less than 800 V;

exposure means for applying a light beam bearing image information to said image carrier charged by said charging means, thereby forming an electrostatic latent image corresponding to said image;

developing means, biased to a potential Vb so that said developing bias potential Vb is more than 200 V and less than 500 V and a potential difference $Vo-Vb$ between said surface potential Vo and said developing bias potential Vb is more than 50 V and less than 300 V, for (a) developing said electrostatic latent image by means of a developing agent, thereby forming a developed image on said surface of the image carrier and (b) removing, simultaneously with the development of said electrostatic latent image, any developing agent remaining on the surface of said image carrier after a previous use of said developing means;

transfer means for transferring the developed image from said image carrier to said recording medium; and disturbing means for disturbing but not removing the developing agent remaining on the surface of said image carrier after the transfer of the developed image and before the next image forming operation to facilitate cleaning thereof.

2. An image-forming apparatus according to claim 1, wherein said disturbing means is disposed between said charging means and said transfer means.

3. An image-forming apparatus according to claim 1, wherein said disturbing means comprises a brush member.

4. An image-forming apparatus according to claim 1, wherein said developing means comprises a developing unit for carrying out a reverse-development.

5. An image-forming apparatus according to claim 1, wherein said developing means comprises a magnetic roller for developing the electrostatic latent image and for removing, simultaneously with development of said electrostatic latent image, any developing agent remaining on the surface of said image carrier by forming a magnetic brush of the developing agent thereon and bringing the magnetic brush into contact with said image carrier.

6. An image-forming apparatus according to claim 6 further comprising means for stirring the developing agent inside the apparatus and replenishing the developing agent with said magnetic roller and restricting means for restricting a thickness of said magnetic brush.

* * * * *